US005102123A

United States Patent [19]

Roark

[11] Patent Number: 5,102,123

[45] Date of Patent: Apr. 7, 1992

[54] METHOD FOR ATTACHING A WEIGHT TO A LEG FOR EXERCISING LEG AND BUTTOCK MUSCLES

[76] Inventor: Carlton Roark, 5580 La Jolla Blvd. #300, La Jolla, Calif. 92037

[21] Appl. No.: 518,552

[22] Filed: May 3, 1990

Related U.S. Application Data

[63] Continuation-in-part of Ser. No. 353,154, May 11, 1989, abandoned, which is a continuation of Ser. No. 130,810, Dec. 9, 1987, abandoned.

[51] Int. Cl.[5] ..... A63B 21/065

[52] U.S. Cl. ..... 482/105; 482/106

[58] Field of Search ..... 272/67, 68, 117, 119, 272/122, 123, 143, 96

[56] References Cited

U.S. PATENT DOCUMENTS

| | | | |
|---|---|---|---|
| 2,617,650 | 11/1952 | Landis | 272/122 |
| 3,734,493 | 5/1973 | Hasekian | 272/122 |
| 3,751,031 | 8/1973 | Yamauchi | 272/117 |
| 4,109,908 | 8/1978 | Puhk et al. | 272/119 |
| 4,180,261 | 12/1979 | Kolka | 272/119 |
| 4,303,239 | 12/1981 | Walsh, Jr. | 272/119 |
| 4,351,526 | 9/1982 | Schwartz | 272/122 |
| 4,355,801 | 10/1982 | Thomsen | 272/119 |
| 4,361,324 | 11/1982 | Baroi | 272/123 |
| 4,632,389 | 12/1986 | Moss | 272/119 |
| 4,722,523 | 2/1988 | Yang | 272/122 |
| 4,809,974 | 3/1989 | Buhr | 272/119 |

FOREIGN PATENT DOCUMENTS

| | | | |
|---|---|---|---|
| 3736 | 3/1887 | United Kingdom | 272/119 |
| 550961 | 2/1943 | United Kingdom | 272/122 |
| 8701951 | 4/1987 | World Int. Prop. O. | 272/119 |

*Primary Examiner*—Robert Bahr

[57] ABSTRACT

A device and method of exercise for exercising the hamstring/gluteal muscles comprising the steps of; providing a weighted means, attaching said weighted means approximate the knee with a fastening means, and performing leg lifts. More specifically, weighted means comprise a standard dumbbell. Fastening means is comprised of a strap comprised of hook and loop material. That location described as approximate the knee, is more specifically defined as the hollow of the knee. Leg lifts comprise that exercise commonly referred to as donkey kicks from a position of being on ones hands and knees. This device and method of exercise of the present invention incorporates that position of the users body that fully engages the hamstring/-gluteal muscles prior to initiating, and during the prescribed exercises, thereby allowing full benefit to be attained from the weighted tension directed to them.

9 Claims, 2 Drawing Sheets

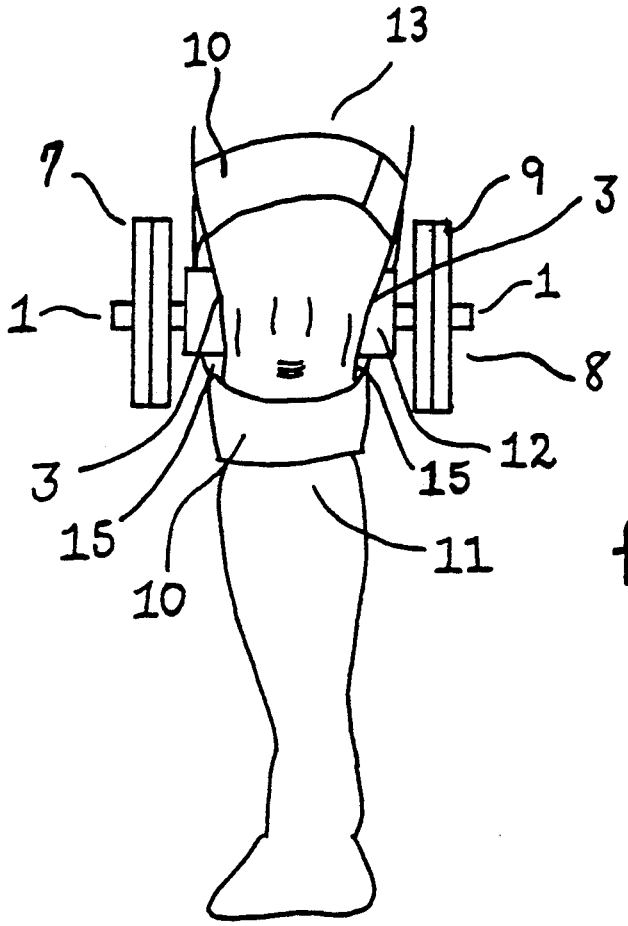
fig. 3
fig. 2
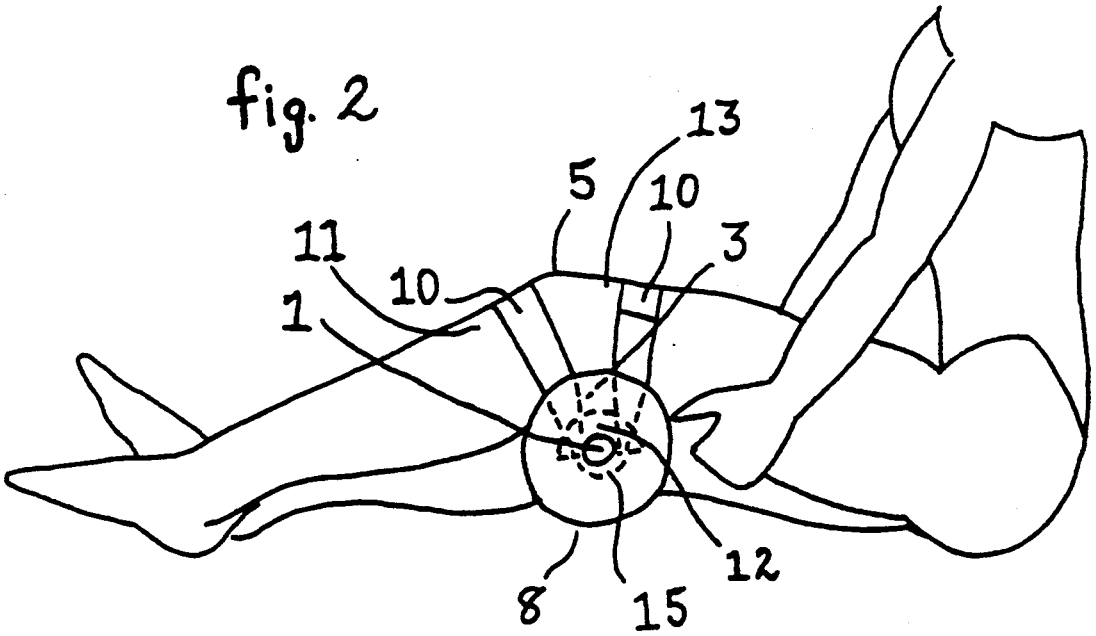

METHOD FOR ATTACHING A WEIGHT TO A LEG FOR EXERCISING LEG AND BUTTOCK MUSCLES

This application is a continuation-in-part of application Ser. No. 07/353,154, filed May 11, 1989, now abandoned, which is a continuation of application Ser. No. 07/130,810, filed Dec. 9, 1987, now abandoned.

BACKGROUND OF THE INVENTION

This invention relates in general to devices by which a weight can be attached to a human leg for exercising the leg, and in particular, to such devices by which a variable weight can be attached to a persons leg at the knee for excercising the Hamstring and Gluteal muscles.

The Hamstring and Gluteal muscle groups, aside from being perhaps two of the most neglected muscle groups in the body, are also ironically two of the largest. We sit on them for long hours every day and only rarely, if ever, subject them specifically to exercise. Its no wonder then that so many of us suffer from a sagging, unsightly bottom. The aforementioned muscles are located at the back of the upper leg and buttocks, respectively.

The significance of these two muscle groups stems mainly from the fact that they are largely responsible for the driving forward motion of the body, which incidentally is best achieved with the upper body forward to approximately 45° (or where the upper body forms an approximately 135° angle to the upper leg/s). For example, while engaging in such activities as bicycling or walking up a steep incline, one has a tendency to lean forward at the waist. This action occurs because of the body's natural predisposition to engaging the Gluteal muscles, which then assist the Hamstring muscles to potentially effect an overall increase in the driving force of the body.

The present invention incorporates positioning of the users body in a manner that fully engages the Hamstring and Gluteal muscles prior to initiating and during the prescribed exercises, thereby allowing full benefit to be attained from the tension, or weighted tension directed to them. Then executing what is commonly referred to as a reverse kick, or donkey kick, the user can efficiently and effectively exercise the aforementioned muscles.

It is well known that this exercise comprising rearward and upward leg thrusts from a position of being on hands and knees, commonly referred to as donkey kicks or reverse kicks, develops strength and tone to a person's lower body, particularly the buttocks and legs of a person performing this exercise. Heretofore, the most common way of performing this exercise was to begin by getting down on a horizontal surface on one's hands and knees with the back approximately parallel to the horizontal surface. Individually, the legs are then thrust backwards and upwards. During the reverse or donkey kick exercise, the lower part of the leg, that is, that portion from the knee through the foot, can be bent at an angle with respect to the thigh or it can be outstretched to be generally colinear with the thigh. A leg held straight during the kick provides maximum tension on the Gluteal muscles which are the primary target of this exercise, but it also causes tension to some degree on the Hamstring muscles and on the knee ligaments. This is due to the weight of the lower portion of the leg and the foot being levered by the length of the lower leg. Those who wish to concentrate on the Gluteal muscles, tend to bend their leg at generally a right angle, thereby relieving a great portion of the tension on the Hamstring muscle and knee ligaments and placing generally all of the tension on the Gluteal muscles. However, bending the leg is disadvantageous in that the weight of the lower leg and foot is no longer levered. This in effect reduces the downward torque felt at the hip joint and thereby reduces the work being done by the Gluteal muscles.

So it can be seen that an exerciser must make a trade off. For maximum work from the Gluteal muscles the leg should be held essentially straight, but in this position the tension is shared between the Gluteal muscles and the Hamstring muscles, causing unnecessary and sometimes injurious strain to be placed upon the knee ligaments. To concentrate on the Gluteal muscles and to relieve strain on the knee ligaments, the exerciser can bend his or her leg, but in doing so the downward torque felt by the Gluteal muscles, and consequently the work being done by said muscles, is greatly reduced.

This invention presents a device whereby a variable weight can be comfortably attached to a person's leg at the knee, which is especially advantageous when used by a person engaging in reverse kick or donkey kick exercises. This is because in the reverse or donkey kick exercise, the hip joint within the Gluteal muscle area acts as a pivot point, and the upper leg acts as the primary lever. By placing a weight at the furthest point out or away from the pivot point or hip joint the greatest amount of torque or tension is realized. This is of extreme importance if one is to attain the highest degree of efficiency and effectiveness with the reverse kick, or donkey kick exercise.

In addition, this invention teaches away from keeping the users back parallel to the floor. Instead the present invention teaches that when on all fours prior to initiating the reverse kick or donkey kick exercise, the user should position themselves such that users head and upper body is bent downward, with the buttocks being generally above all portions of the users upper body. Additionally, the user should attempt to exercise their leg closely around that area where upper leg of leg being exercised is at an approximate 135° angle from users upper body. The present invention also teaches that when performing reverse kick or donkey kick exercises, the user should never raise or kick back leg beyond the point where upper leg of leg being exercised begins to form less than a 180° angle from the users back. In other words, user should never allow leg being exercised and back to become bowed backwards and/or upwardly.

The device of the present invention is attached so that the point of application of the force of gravity, that is, the center of gravity of the variable weight, is at or very proximate the center of the knee joint, and the device is adapted to permit the user to bend his or her knee at generally a right angle in order to place substantially all of the tension on the Gluteal muscles. This combination of attributes permits the exercising person to increase the downward torque felt by the Gluteal muscles without the necessity of having the leg straight. This has great advantage in that the Gluteal muscles can be strengthened and toned without unduly stressing the Hamstring muscles nor the ligaments of the knee.

Although the advantage of the invention with respect to reverse kicks or donkey kicks has only been briefly discussed, it should be noted that this invention can be embodied in numerous other devices or methods not mentioned here, that attach a weighted object to the knee area for performing an increasingly effective and efficient reverse kick or donkey kick exercise. Other variations of the present invention can include, but are not limited to one or more combinations of the follow; weighted cylinders, bars or pipes, form fitting weights, belts, cords, string, wire, elastic or rubber bands, hooks, flexible or pliable weights, foam weights, weights with adhesive or sticky surfaces, etc. Additional advantages and attributes of this invention will be discussed or will be readily discernible upon reading of the text hereinafter.

SUMMARY OF THE INVENTION

A method for affixing weight to a knee of a human leg comprising a weight means and a harness means adapted to secure the weight means to the leg at the knee joint, with a padding means positioned between weight means and knee. The weight means comprises a standard dumbbell. Padding means, which are not required, but is included as a matter of greater comfort and convenience, comprises a folded hand towel. The harness means comprises a single strap comprised entirely of hook and loop material, with a length substantially greater than its width. The length of the strap is greater than 18 inches and less than 60 inches to accommodate different sizes and combinations of leg, padding means and dumbbell, and is preferably adapted to snugly loop around and attach the standard dumbbell to the leg at the back of the knee. One end of strap is comprised of hook material facing one direction, with its opposite end comprised of loop material facing the opposite direction, the ends of which are connected by overlapping the desired amount necessary to adjust the overall length of the strap, in order to secure a snug fit. With dumbbell snugly secured to the back of the knee, also known as the hollow of the knee, the user then positions themselves on all fours and begins executing a modified, and significantly more improved exercise commonly referred to as reverse kicks, or donkey kicks.

An object of this invention is to provide a weighted exercise device, amd method of exercise, whereby two of the body's largest muscle groups, the Hamstring and Gluteal muscles, as well as others, may be more efficiently and effectively exercised.

Another object of this invention provides for a method of exercise that includes a weighted exercise device that is relatively inexpensive, portable lightweight, easy to use, safe and comfortable.

Another object of the present invention is a device and method of exercise, whereby a new and unique dimension to the use and application of the standard dumbbell, or weighted bar, may be obtained.

Still another object of the present invention shows a method of exercise incorporating that particular position of a users body that fully engages the Hamstring and Gluteal muscles.

Still further, another object of the present invention illustrates method of exercise incorporating a device that most significantly improves upon the traditional reverse kick or donkey exercise.

An additional object of the present invention is to provide an exercise apparatus and method of exercise as described above which may be used for a number of other exercises than the one for which it is primarily designed.

Other objects of this invention will be readily discernible upon reading of the text hereinafter.

BRIEF DESCRIPTION OF THE DRAWINGS

FIG. 2 is a side view of the users leg with the present invention attached thereon at the knee joint.

FIG. 3 is a top view of the users leg with the present invention attached thereon at the knee joint.

REFERENCE NUMERALS IN DRAWINGS

Figure 1:
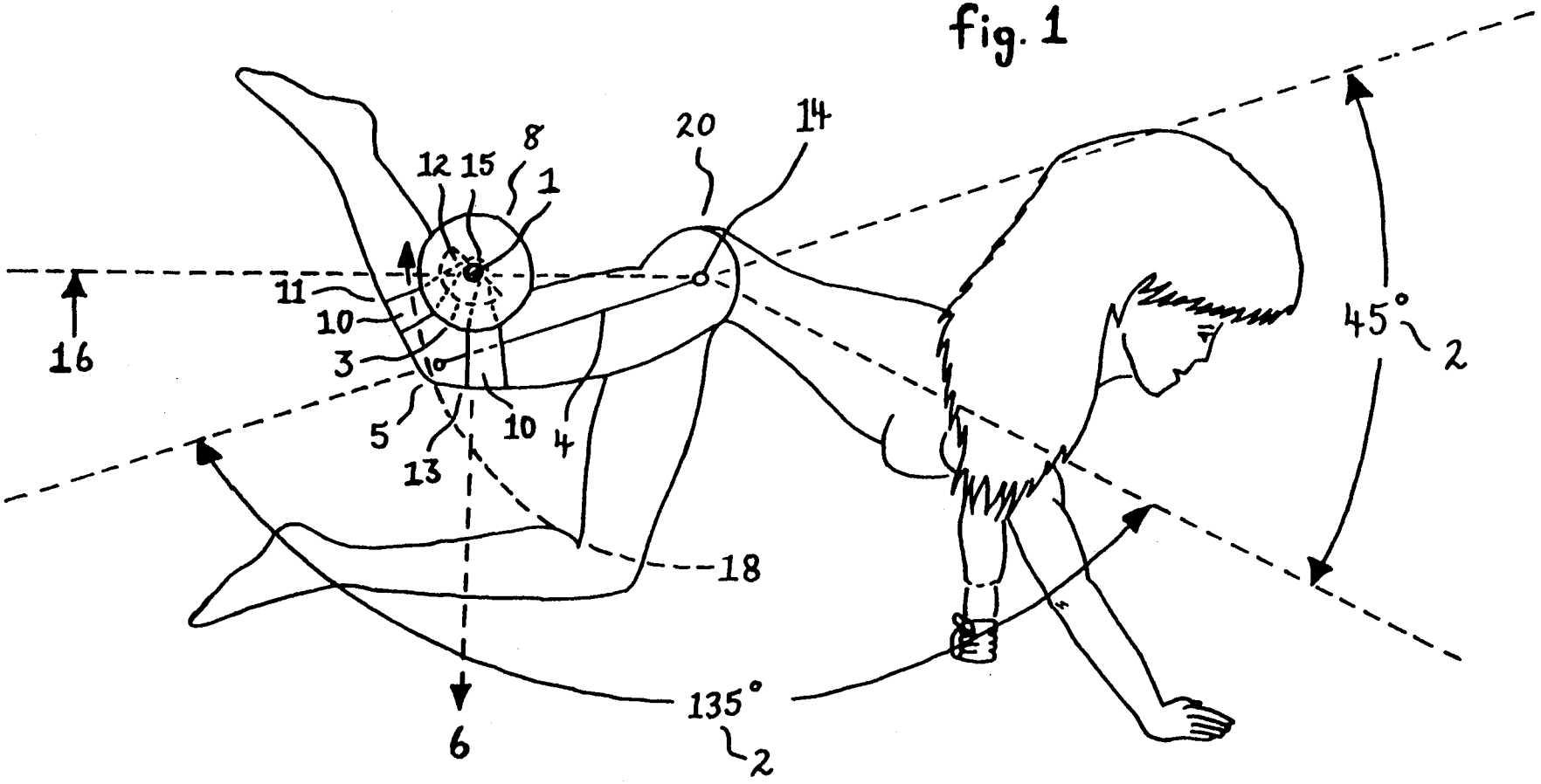
FIG. 1 is a pictorial representation, illustrating how the present invention incorporates positioning of the users body in a manner that fully engages the Hamstring and Gluteal muscles prior to initiating and during the prescribed reverse kick exercises, thereby allowing full benefit to be attained from the weighted tension directed to them

1 weight bar
2 angular body position required to fully engage the hamstring/gluteal muscles
3 hollow/back of knee
4 the upper leg which functions as the primary lever, and is used to torque the gluteals
5 knee joint
6 gravitational pull
7 weight discs
8 standard dumbbell
9 weight discs
10 strap fastening means
11 below front of knee
12 folded hand towel
13 above front of knee
14 the hip joint which functions as the pivot point or fulcrum of the primary lever 4 mentioned above
15 point where strap 10 passes under bar 1, to hold bar 1 securely to hollow 3 of knee 5.
16 suggested maximum lift point for leg being exercised
18 range of motion for torqueing the gluteals
20 the buttocks or gluteals, which are the primary area of concentrated torqued tension

DECRIPTION, FIGS. 1, 2 AND 3

Referring to FIGS. 1, 2 and 3, a bar 1 is shown to be disposed in the hollow 3 of a persons knee joint 5. Bar 1 has symmetrically mounted on its opposite ends 7 and 9, a plurality of weight discs. Bar 1 is secured in the hollow of the knee joint by a strap 10. Strap 10 passes over the front of the leg both above 11 and below 13 the knee joint, and passes under 15 bar 1 on both sides of knee joint 5. Strap 10 is comprised of hook and loop material and the strap ends are adjustably connected by conventional hook and loop means. Preferably, a pad, adapted to generally conform to the shape of the hollow of the knee is interposed between the hollow 3 and the bar 1 to prevent discomfort due to bar 1 pressing against the back or hollow 3 of the knee. The preferred embodiment of this pad is simply a folded hand towel 12, and is not required, but is included as a matter of greater comfort and convenience only. The weight discs 7 and 9 are preferably removable and replaceable so that the total weight can be selectively varied, although a comparable option would be to simply use one piece dumbbells of varying weights.

OPERATION, FIGS. 1, 2, and 3

To begin, a user applies a folded hand towel 12 to fit over weight bar 1 as shown in FIGS. 1, 2 and 3. Sitting on a horizontal surface with legs extended, user raises left leg up and places dumbbell 8 just underneath the back or hollow 3 of knee, keeping folded hand towel 12 in place. User then centers strap 10 across left leg just below front of knee. User then pulls strap ends and under weight bar 1 and up over the top front of knee. Strap ends are pulled up tightly to secure dumbbell 8 firmly in hollow 3 of knee. Hook and loop ends of strap 10 are then connected by overlapping the desired amount necessary to adjust the overall length of strap 10, in order to secure a snug fit.

With dumbbell 8 fastened securely to left leg, user slowly turns body around to position themselves on hands and knees. With head and upper body bent downward and slightly forward 2, user positions left hand out to their front left, with right forearm placed down across floor pointing to users left. User then begins exercise by raising up left leg, swiveling at the hip 14, to a maximum lift point 16. User then brings leg back to the starting position which is when upper leg 4 is approximately perpendicular to floor. This represents one complete repetition 18. The force of gravity 6 on dumbbell 8 creates a high degree of torqwue and concentrated tension to the Gluteal/Buttock muscles 20, thus providing the user with the absolute most effective and efficient method for exercising the Gluteal/Buttock muscles 20. To exercise opposite side of Buttocks, user simply reverses instructions above and position accordingly.

SUMMARY, RAMIFICATIONS AND SCOPE

Accordingly, the reader will realize that the present invention teaches the attachment of a weighted device to the knee area by method of an attachment means for performing a more modified reverse kick exercise, that is increasingly more effective and efficient. Additional advantages of the present invention are:

A) A device and method of exercise that more effectively and efficiently exercises two of the largest, and ironically, most neglected muscle groups in the human body.

B) A method of exercise that includes a weighted exercise device that is relatively well known, commonplace, inexpensive, portable, lightweight, easy to use, safe and comfortable.

C) A device and method of exercise whereby a new and unique dimension to the use and application of the standard dumbbell, or weighted bar, may be obtained.

D) A method of exercise incorporating that particular position of a users body that fully engages the hamstring and gluteal muscles prior to, and during, the prescribed exercises.

E) A method of exercise incorporating a device that most significantly improves upon the traditional reverse kick or donkey kick exercise.

F) A method of exercise that teaches away from keeping the users back parallel to the floor during the reverse kick exercise, and instead, keeping the head and upper body positioned downward, with the buttocks being generally above all portions of the users upper body.

G) A method of exercise that teaches away from allowing leg being exercised and back to become bowed backwards and/or upwardly during a reverse kick exercise.

H) A device and method of exercise that incorporates the scientific principles of torque and leverage as it applies to body mechanics and exercise kinesiology.

I) A device and method of exercise for exercising the gluteals that will ultimately and inevitably ensure its user of achieving a firm and shapely derriere.

Although the description above contains many specificities, these should not be construed as limiting the scope of the invention, but as merely providing illustrations of some of the presently preferred embodiments. For example, the weighted device and fastening means could be two separate independent products used together, or could be one complete product encompassing all elements previously discussed. Weight means could include any device capable of weighting a leg, variable or otherwise. Fastening means can include any method of attachment, not limited to those already discussed, sufficient to accomplish the intentions of the present invention.

Thus, the scope of this invention should be determined by the appended claims and their legal equivalents, rather than by any examples given.

I claim:

1. A method of exercising the legs and buttock muscles using a weighted bar and a strap having fasteners at least at its ends, the method comprising the steps of:

(a) locating the weighted bar substantially in the hollow of the knee;

(b) placing the strap such that it passes over the front of the leg, both above and below the kneecap, and under the weighted bar proximate both sides of the knee, and affixing the fasteners at the ends of the strap together; and, (c) lifting the leg with the weighted bar retained substantially in the hollow of the knee.

2. The method of claim 1, wherein the fasteners include hook and loop fasteners.

3. The method of claim 1, wherein the weighted bar comprises a plurality of weighted discs symmetrically mounted on the opposite ends of the weighted bar.

4. The method of claim 1, wherein step (c) includes placing the hands and knees on a support surface and lifting the leg.

5. The method of claim 1, wherein step (b) comprises placing the center of the strap over the front of the leg below the kneecap, bringing both ends of the strap around to the back of the leg and over the weighted bar, and bringing both ends of the strap back around to the front of the leg above the kneecap and affixing the fasteners at the ends of the strap together.

6. A method of exercising the legs and buttock muscles using a weighted bar having a plurality of weight discs mounted on its opposite ends and a strap having fasteners at least at its ends, the method comprising the steps of:

(a) locating the weighted bar substantially in the hollow of the knee;

(b) placing the center of the strap over the front of the leg below the kneecap, bringing both ends of the strap around to the back of the leg and over the weighted bar, and bringing both ends of the strap back around to the front of the leg above the kneecap and affixing the fasteners at the ends of the strap together; and, (c) lifting the leg with the weighted bar retained substantially in the hollow of the knee.

7. The method of claim 6, wherein the fasteners include hook and loop fasteners.

8. The method of claim 6, wherein the plurality of weighted discs are symmetrically mounted on the ends of the weight bar.

9. The method of claim 6, wherein step (c) includes placing the hands and knees on a support surface and lifting the leg.

* * * * *